United States Patent [19]

Banjo et al.

[11] Patent Number: 4,789,347

[45] Date of Patent: Dec. 6, 1988

[54] MEMORY CARD

[75] Inventors: Toshinobu Banjo; Yasuhiro Murasawa; Shigeo Onoda, all of Itami, Japan

[73] Assignee: Mitsubishi Denki Kabushiki Kaisha, Japan

[21] Appl. No.: 154,322

[22] Filed: Feb. 10, 1988

[30] Foreign Application Priority Data

Mar. 31, 1987 [JP] Japan ..... 62-79918

[51] Int. Cl.[4] ..... H01R 13/44

[52] U.S. Cl. ..... 439/140; 439/93; 439/137

[58] Field of Search ..... 439/136–140, 439/93, 95, 386

[56] References Cited

U.S. PATENT DOCUMENTS 3,095,523 6/1963 Stith ..... 439/93
4,592,608 6/1986 Ohtsuka et al. ..... 439/140
4,695,925 9/1987 Kodai et al. ..... 439/137

FOREIGN PATENT DOCUMENTS 59-127284 7/1984 Japan .

*Primary Examiner*—Gil Weidenfeld
*Assistant Examiner*—Paula A. Austin
*Attorney, Agent, or Firm*—Leydig, Voit & Mayer

[57] ABSTRACT

A memory card having: a card-like package; a semiconductor module disposed within the package; a plurality of electrode terminals mounted on the package for allowing an external electrical connection of the semiconductor module in the package to an external circuit, the electrode terminals including an earth electrode terminal; a metallic shutter disposed on the package and movable between an open position in which the electrode terminals are exposed for the electrical connection and a closed position in which the electrode terminals are covered; an electrically conductive spring having one end electrically connected to the shutter and the other end secured to the package for biasing the shutter toward the closed position; and a conductor for electrically connecting the other end of the spring to the earth electrode terminal.

5 Claims, 1 Drawing Sheet

MEMORY CARD

BACKGROUND OF THE INVENTION

This invention relates to a memory card such as an IC card for use in a game machine and, more particularly, to a shutter for covering electrode terminals of the card.

The type of memory card that is used is an IC card which contains TV game software or as a desk card for use in a microcomputer system has a structure such as that shown in FIG. 1. A memory card 1 (hereinafter simply referred to as "card") has a multiplicity of electrode terminals 3 disposed on the obverse surface of a package 2 at one end thereof. The package 2 accommodates a semiconductor module 2*b* in which thin semiconductor modules, electronic parts, a thin cell battery such as a mercury cell, and so forth are incorporated. A shutter 4 is formed from a thin metallic plate and adapted to cover the electrode terminals 3. The shutter 4 is supported in such a manner that it can open or close by sliding in the longitudinal direction of the card as indicated by the arrow A. The shutter 4 has a pair of downwardly bent projections 4*a* formed at its extreme ends.

FIGS. 2 and 3 show, in plan and in a side view, a state in which the shutter 4 is slightly open. A pair of spring accommodation grooves 2*a* are formed in a front end portion of the obverse surface of the package 2 at opposite ends thereof. A spring-hitching pin 5 made of metal is fixed to a front end portion of each spring accommodation groove 2*a*, and spring-hitching pins 6 made of metal are fixed to the shutter 4. A return spring 7 which is formed of electrically conductive material is stretched between the pins 5 and 6 and functions to close the shutter 4 in a normal state. A pair of shutter receiving pins 9 are provided in a connector disposed on the side of a card reader (both not shown) and which correspond to the projections 4*a* of the shutter 4 of the card 1 inserted into the card reader.

If the card 1 is inserted into the connector, the projections 4*a* of the shutter 4 abut against the receiving pins 9 and the shutter 4 is thereby opened. The electrode terminals 3 of the card 1 are thereby brought into contact with electrode-contacting pieces (not shown) of the connector.

In this type of conventional memory card, the shutter 4 can be charged with static electricity such as frictional electricity caused by the opening-closing operation, or static electricity charged by human contact, and this static electricity causes, through the electrode terminals 3, malfunctions of the incorporated semiconductor module.

SUMMARY OF THE INVENTION

This invention has been achieved with a view to overcoming this problem, and an object of the present invention is to provide a memory card in which the shutter is grounded to earth potential in order to prevent malfunctions due to static electricity.

To this end, the present invention provides a memory card having a connection means which connects the spring-hitching pin fixed to the package body and adapted for drawing the return spring for closing the shutter to an earth terminal in the electrode terminals.

In this memory card, static electricity on the shutter is released to the earth so that the shutter is kept constantly and substantially equal to the earth potential and, therefore, there is no possibility of malfunctions of the card due to the presence of such static electricity.

DESCRIPTION OF THE PREFERRED EMBODIMENT

Figure 1:
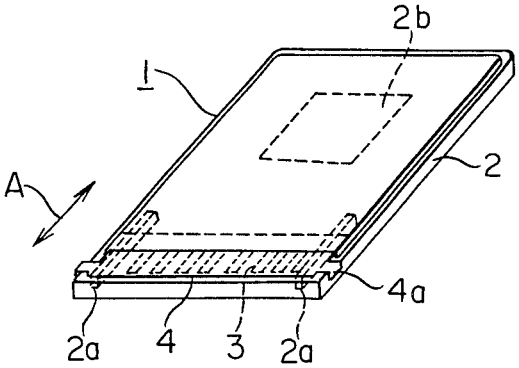
FIG. 1 PRIOR ART
FIG. 1 is a schematic perspective view of a conventional memory card, illustrating a state in which the shutter is closed.
Figure 2:
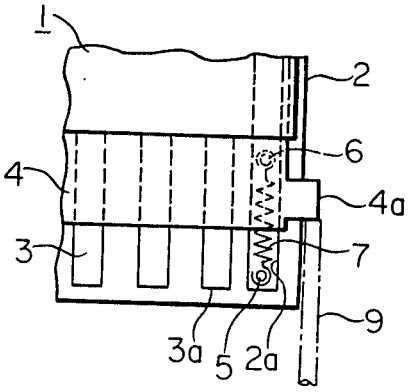
FIG. 2 PRIOR ART
FIG. 2 is an enlarged plan view of part of the memory card shown in FIG. 1, illustrating a state in which the shutter is slightly open.
Figure 3:
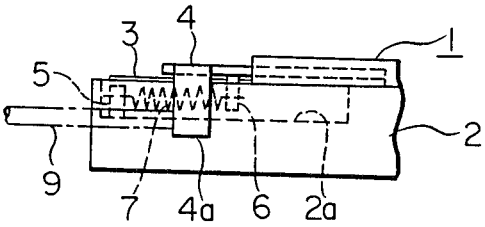
FIG. 3 PRIOR ART
FIG. 3 is an enlarged side view of part of the memory card shown in FIG. 1, illustrating a state in which the shutter is slightly open.
Figure 4:
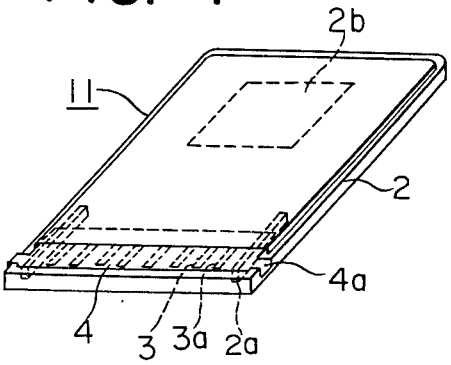
FIG. 4 is a schematic perspective view of a memory card which represents an embodiment of the present invention, illustrating a state in which the shutter is closed.

FIG. 4 shows a memory card which represents an embodiment of the present invention. In the state shown in FIG. 4, the shutter 4 is closed. A card 11 is provided with a package 2 made of an insulating material such as a synthetic resin, and a semiconductor module 2*b* is incorporated in the package 2. A multiplicity of electrode terminals 3 are disposed on the obverse surface of the package 2 at the front end thereof, one of the electrode terminals 3 serving as an earth terminal 3*a*. A shutter 4 is adapted to cover the electrode terminals 3 and is capable of opening and closing.

Figure 5:
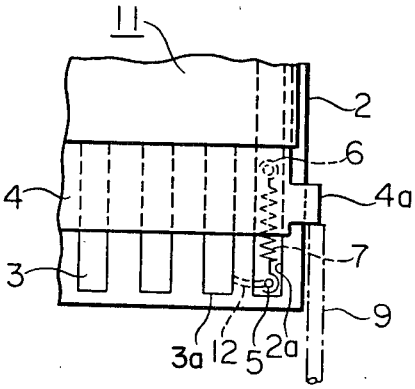
FIG. 5 is an enlarged plan view of part of the memory card shown in FIG. 4, illustrating a state in which the shutter is slightly open.
Figure 6:
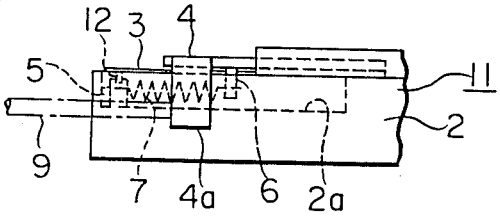
FIG. 6 is an enlarged side view of part of the memory card shown in FIG. 4, illustrating a state in which the shutter is slightly open.

FIGS. 5 and 6 are enlarged plan and side views of part of the card in which the shutter is slightly open. A spring-hitching pin 5 which is formed from a metallic material and which is fixed to a front end portion of a spring accommodation groove 2*a* formed in the package 2 is connected to the earth terminal 3*a* by a connection means, namely, a connection lead 12. The shutter 4 is thereby connected to the earth terminal 3*a* via a spring-hitching pin 6, a return spring 7, the spring-hitching pin 5 and the lead 12 so that it is kept substantially equal to the earth potential.

If the card 11 is inserted into a connector disposed on the side of a card reader (both not shown), projections 4*a* of the shutter 4 abut against shutter receiving pins 9 disposed on the connector so as to open the shutter 4, whereby the electrode terminals 3 are brought into contact with electrode-contacting pieces (not shown) of the connector. If the card 11 is drawn and detached from the connector, the shutter 4 is closed by the return spring 7, thereby covering the electrode terminals 3. Even if static electricity is generated by this opening or closing movement of the shutter 4, the static electricity is released via the earth terminal 3*a* so that the shutter is kept substantially equal to the earth potential.

Any method of forming the lead 12 may be used to connect the spring-hitching pin 5 and the earth terminal 3*a* as long as it does not impede the connection at other terminals when the card is inserted into the connector. For example, the lead 12 may be introduced through an internal portion of the package 2 and connected to the reverse side of the earth terminal 3*a*. Further, in the present invention, methods in which the earth terminal 3*a*and a portion of the return spring 7 are directly connected by a lead may be used.

In accordance with the present invention, as described above, the spring-hitching pin made of a metallic material which is disposed on the package 2 and adapted to set the return spring for the purpose of closing the shutter is connected to the earth terminal by a lead, thereby keeping the shutter equal to the earth potential and preventing any malfunctions of the semiconductor module in the card due to the presence of static electricity.

What is claimed is:

1. A memory card comprising:

a card-shaped package;

a semiconductor module disposed within said package;

a plurality of electrode terminals mounted on said package for allowing an external electrical connection of said semiconductor module in said package to an external circuit, said electrode terminals including an earth electrode terminal;

a metallic shutter disposed on said package and movable between an open position in which said electrode terminals are exposed for said electrical connection and a closed position in which said electrode terminals are covered;

an electrically conductive spring having one end electrically connected to said shutter and the other end secured to said package for biasing said shutter toward said closed position; and connecting means for electrically connecting said other end of said spring to said earth electrode terminal.

2. A memory card as claimed in claim 1, wherein said connecting means comprises an electrically conductive spring holder secured to said package to which said other end of said spring is electrically connected, and an electrical conductor connected between said spring holder and said earth electrode.

3. A memory card as claimed in claim 2, wherein said electrical conductor extends through said package and is connected to said earth electrode at the portion thereof that is not exposed on the surface of said package.

4. A memory card as claimed in claim 2, wherein said electrode terminals are mounted on a major surface of said card-shaped package to extend therealong, and said shutter is slidable along said major surface between said open and closed positions.

5. A memory card as claimed in claim 2, wherein said electrode terminals are mounted on a major surface of said card-shaped package to extend therealong, said shutter is slidable along said major surface between said open and closed positions, and said package has a groove for receiving said spring therein.

* * * * *